United States Patent [19]

Yoshida

[11] 4,401,295

[45] Aug. 30, 1983

[54] APPARATUS FOR TREATING MOLTEN METAL

[75] Inventor: Tsutomu Yoshida, Nagoya, Japan

[73] Assignee: Sumitomo Light Metal Industries, Ltd., Tokyo, Japan

[21] Appl. No.: 380,937

[22] Filed: May 21, 1982

[30] Foreign Application Priority Data

May 27, 1981 [JP] Japan ..... 56-80289

[51] Int. Cl.[3] ..... F27B 3/20

[52] U.S. Cl. ..... 266/207; 75/68 R; 266/214; 266/220; 266/227; 266/235

[58] Field of Search ..... 266/217, 220, 227, 235, 266/207, 214; 75/68 R

[56] References Cited

U.S. PATENT DOCUMENTS

| | | | |
|---|---|---|---|
| 3,743,263 | 7/1973 | Szekely | 75/68 R |
| 3,743,500 | 7/1973 | Foulard et al. | 266/220 |
| 3,917,242 | 11/1975 | Bass et al. | 75/68 R |
| 4,067,731 | 1/1977 | Chia | 75/68 R |

*Primary Examiner*—Melvyn J. Andrews
*Attorney, Agent, or Firm*—Browdy & Neimark

[57] ABSTRACT

An apparatus for treating a molten metal to a high quality by means of applying gas treating and filtration consecutively in a simple compact treating vessel. The vessel is divided into two parts, i.e., fluxing and filtration compartments, by a vertical partition wall having a molten metal passage therein integrally formed with the vessel, and a vacant space is left above the top of the partition wall and the ceiling of the vessel of sealed box type for allowing communication of the upper space above the bath level in both compartments. In two chambers formed in the fluxing compartment divided by a pair of dividers a respective gas treating device including a graphite pipe supplying treating gas and a rotor body to stir the molten metal is inserted from above. In the filtration compartment a plurality of tube filters are disposed for separating suspended particles before flowing the passed clean molten metal out of the vessel, and a gas burner of variable flame is mounted in the ceiling for heating the molten metal, and further a gas blowing means is disposed in the bottom thereof for blowing discrete bubbles of a gas upwards. A chimney is disposed in the ceiling of the fluxing compartment for discharging exhaust gases upwards.

8 Claims, 3 Drawing Figures

APPARATUS FOR TREATING MOLTEN METAL

FIELD OF THE INVENTION

This invention relates to an apparatus for treating a molten metal, and more particularly to an apparatus capable of removing dissolved gases, non-metallic suspended particles, etc., effectively and efficiently, from a molten metal, above all molten aluminum or its alloys.

BACKGROUND OF THE INVENTION

Molten metals generally contain, prior to the casting, plenty of dissolved gases and suspended particulate inclusions. It is therefore absolutely necessary to remove those harmful materials therefrom for preventing deterioration of the quality of cast ingots and further of finished articles processed through rolling, forging, extruding and the like. As such dissolved gases and suspended inclusions seen, for example, in molten aluminum, there can be mentioned hydrogen gas dissolved, oxides of aluminum and magnesium, and non-metallic suspended particles of refractory materials. Now the removal of those dissolved gases and mixed inclusions is regarded as the most important matter in the molten metal treating or refining process for casting.

One of the traditional processes for removing such dissolved gases and harmful inclusions, involves a method of simply inserting a straight pipe of graphite in the molten metal contained in a melting furnace or a holding furnace for infusing therethrough treating gas, for example, nitrogen gas containing chlorine. It is still problematical in its insufficient treatment efficiency and high rate of loss of the molten metal through oxidation thereof.

For overcoming those problems, a proposition of an apparatus was made in U.S. Pat. Nos. 3,743,263 and 3,839,019, and publicized patent application TOKU-KAI-SHO-54(1979)142104 (Japan) by co-inventors including the inventor of the present invention, wherein a rotor as a stirring mechanism is inserted into the molten metal contained in the melting furnace and a predetermined treating gas is introduced thereinto, while the rotor is rotated so as to stir the metal, in a state of discrete bubbles, so that the purposed treatment may be performed through the gas/metal contact. This treating method in such an apparatus, where the metal is treated with fine discrete bubbles of the gas, has highly improved the treatment efficiency for the molten metal (refining efficiency) in comparison to the traditional direct gas infusion method through a graphite pipe.

The above-mentioned method still leaves something to be desired, irrespective of its great improvement, because the efficiency enhancement is not infinite but rests under a certain extent of limit. Further step of purifying or refining the molten metal, for providing ingots of supreme quality which the present day market requires, is keenly needed. In particular, attempts of increasing the amount of introduced treating gas and strengthening of the stirring movement for the purpose of raising the treatment efficiency gave rise to some other problems in respect of the structure of the apparatus and the unexpected phenomena such as re-absorption of the removed hydrogen gas, formation of some oxides through contact with air which are caused by violent waving and splashing of the molten metal surface, i.e., bath surface. It may sometimes deteriorate refining efficiency of the molten metal, being still far from an optimum measure.

On the other hand several kinds of filtering devices were also attempted so as to remove suspended particles in the molten metal, generally of non-metallic material, such as a device employing a screen fibers made of glass filter or stainless steel, another device having a filtering layer containing alumina balls, and still another device having a porous filter made by sintering aggregate materials such as corundum. Those filtering devices were after all filters for removing particles of certain sizes. They were of course incapable of removing particles of fine sizes, dissolved gas for example hydrogen and inclusions such as sodium in the molten metal. Furthermore, for removing particles of fine sizes, a filled-up layer of alumina balls was incompetent, and diminishing of meshes of the above-mentioned filtering devices and porous filters, irrespective of temporary enhancement of the filtering effect for suspended particles, showed an adverse result of clogging of the filtering devices and filters with the particles themselves. It disadvantageously hindered long term continuous filtration.

SUMMARY OF THE INVENTION

It is a primary object of this invention, which has been made from the above-mentioned background, to provide an apparatus for treating molten metals to obtain highly refined ones.

It is another object of this invention to provide a compact apparatus for refining molten metals, particularly aluminum and its alloys, capable of effectively and efficiently removing dissolved gases, non-metallic suspended particles, etc., under energy economizing conditions.

Other objects of this invention will become apparent to those skilled in the art from the following detailed description of the preferred embodiments when read in connection with the accompanying drawing.

A treating apparatus according to this invention is, for achieving the just mentioned objects, characteristically provided with (a) a sealed treating vessel having inlet means for introducing molten metal to be treated and outlet means for discharging the molten metal which has been treated; (b) a partition member vertically extending to divide the vessel into two parts, i.e., a fluxing compartment located on the side of the inlet means and a filtration compartment located on the side of the outlet means, having a molten metal passage in the lower portion thereof, for leading there through the molten metal treated in the fluxing compartment into the filtration compartment, and leaving a vacant space thereabove between the top of itself and the ceiling portion of the vessel for allowing formation of a communication passage linking an upper space above the fluxing compartment and another upper space above the filtration compartment; (c) molten metal treating means disposed in the fluxing compartment for treating the molten metal introduced through the inlet means by means of blowing a predetermined treating gas thereinto in a state of fine discrete bubbles, while a rotor is rotated to stir and circulate the molten metal for expediting the treatment with the blown gas; (d) filtering means disposed in the filtration compartment for filtering the molten metal, introduced from the fluxing compartment into the filtration compartment through the molten metal passage in the partition member, so as to separate suspended particles in the molten metal, and flowing the filtered molten metal out of the vessel through the outlet means; and (e) burner means disposed in the ceiling portion of the vessel, above the filtration compartment, for heating the molten metal by means of produced combustion flame and/or combustion gas of high temperature.

Principal advantages of this invention can be summarised as follows: By means of dividing the treating vessel into two compartments, fluxing and filtration, for consecutively imparting the fluxing treatment and the filtering treatment in each compartment to the molten metal, the apparatus has been made compact as a whole and the treatment efficiency has been largely enhanced, enabling easy production of molten metal of high quality. Disposition of the burner means for effectively heating both treatment compartments and the molten metal held therein has resulted in simplification of the apparatus and energy economy in the heating. The heating by means of the burner means has been enhanced of its effect owing to disposition of an exhaust gas discharging device in the fluxing compartment, because the high temperature combustion gas produced by the burner means can be ingeniously utilized by being led into the fluxing compartment.

Some other advantages from additional devices attached to the apparatus are noted below.

Disposition of some flow baffling means in a section of the vessel corresponding to the fluxing compartment has proved to be greatly helpful in enhancing the treatment effect to the flowing molten metal by the fine discrete bubbles of the treating gas.

Due to disposition of gas blowing means in the bottom portion of the vessel corresponding to the filtration compartment, stirring and circulating of the molten metal in the vessel caused by the blowing of fine discrete bubbles of the blown gas from the gas blowing means, and contact between the fine discrete bubbles and the abovementioned filtrating means, uniformalization of the molten metal temperature has been greatly improved with the aid of the heating by the burner means, and clogging of the filtration means has also been greatly prevented. It has enabled the molten metal treatment for a long continuous time and in large quantity.

DETAILED DESCRIPTION OF A PREFERRED EMBODIMENT

An embodiment of this invention will be described in detail with reference to the appended drawings. It goes without saying that this invention is not limited at all to the exemplified embodiment.

Figure 1:
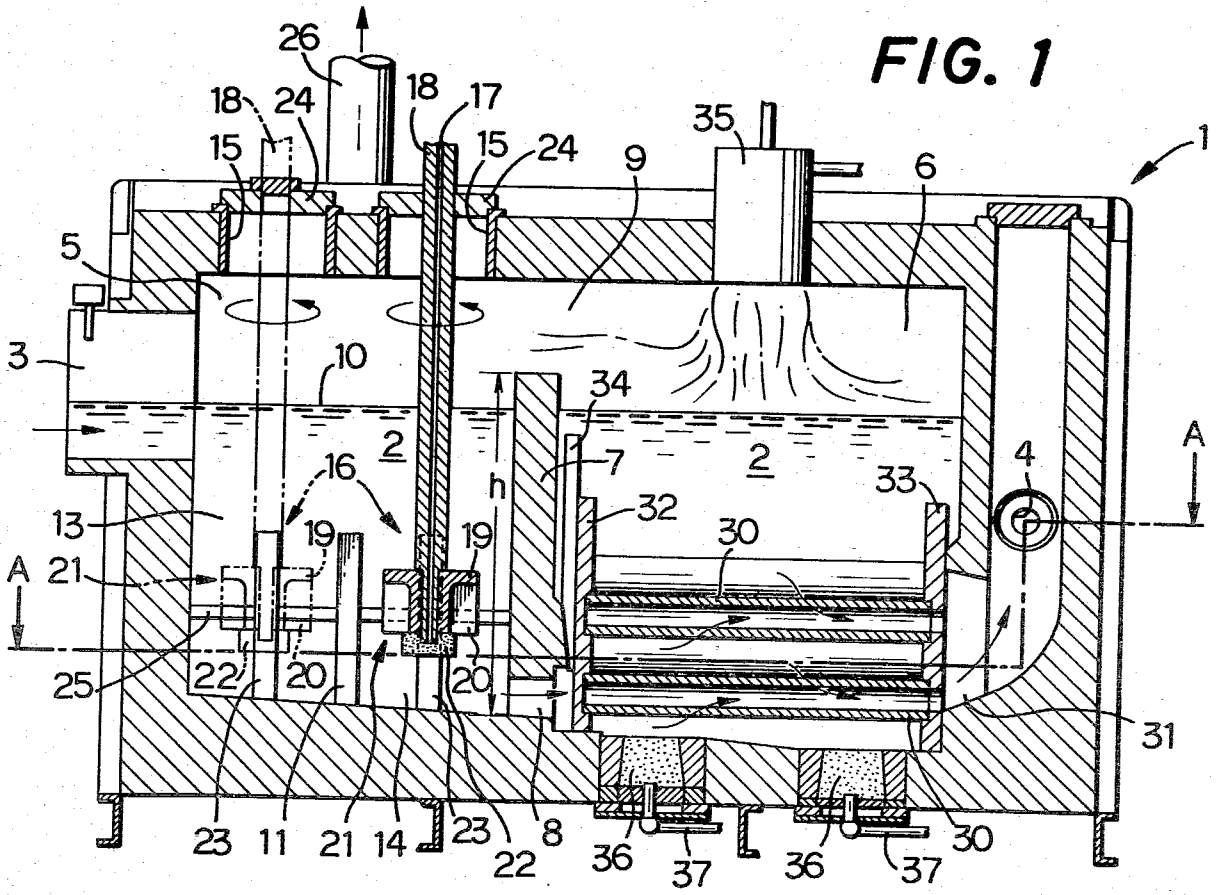
FIG. 1 is a vertical sectional view, in elevation, of an embodiment of an apparatus in accordance with this invention.
Figure 2:
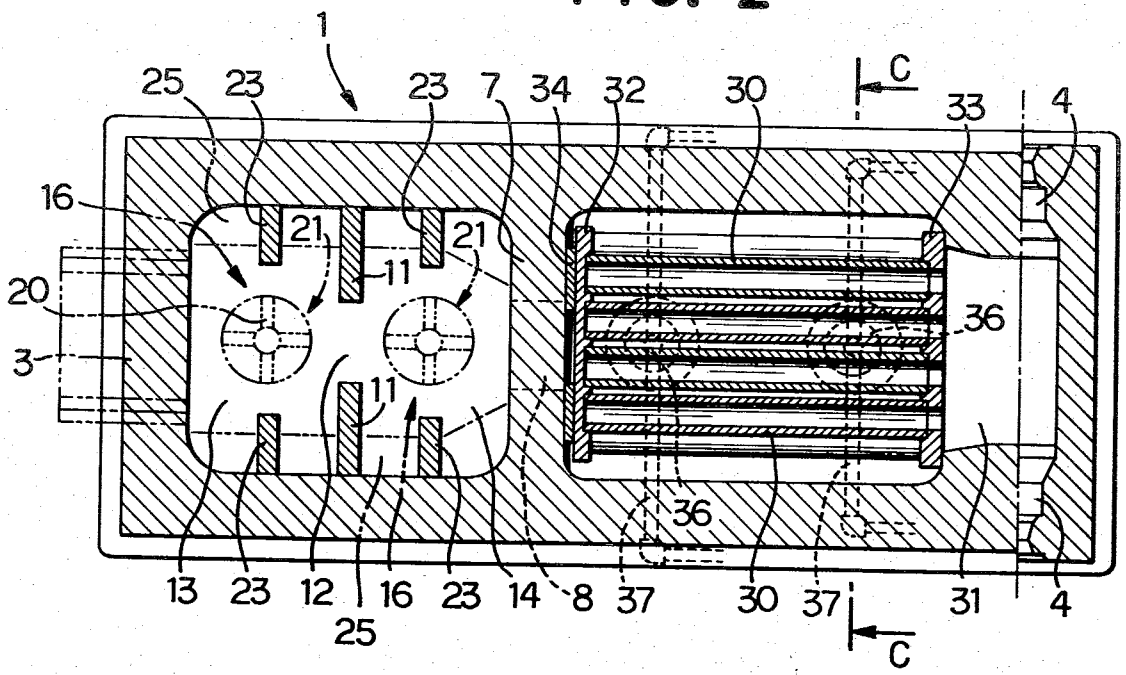
FIG 2 is a sectional view of the embodiment taken along the section line A—A in FIG. 1.
Figure 3:
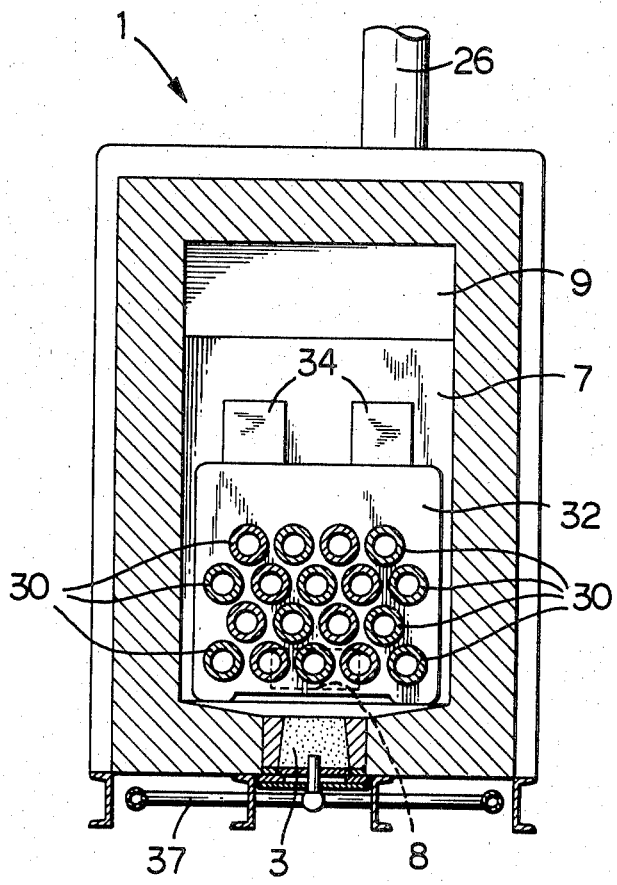
FIG. 3 is a sectional view of the same embodiment taken along the section line B—B in FIG. 2.

In FIGS. 1–3, numeral 1 designates a furnace body, or a treating vessel of a refractory material, being of sealed structure of box type. In one longitudinal end portion of the vessel 1 an inlet port 3 for introducing molten metal 2 is provided, and in either side wall near the other end portion of the vessel 1 an outlet port 4 for the molten metal is respectively provided. The predetermined molten metal 2 to be treated is led, from a not-shown source of metal supply such as a holding furnace, into the treating vessel 1, and the molten metal 2, to which has been applied a predetermined refining treatment, is taken out of the vessel 1 through the pair of outlet ports 4, 4 for being introduced into a not-shown casting device or the like.

At about the middle part of the vessel 1, in the longitudinal direction, a partition wall 7 extends vertically to separate the interior of the vessel 1 into two compartments, being side by side longitudinally, i.e., a fluxing compartment 5 on the side of the inlet port 3 and a filtration compartment 6 on the side of the outlet ports 4. The partition wall 7 is integrally formed with the furnace body in a traversing direction, that is in the direction of the width, having a predetermined height (h). In the lower portion of the partition wall 7 is formed a molten metal passage 8, for leading the fluxed molten metal 2 in the fluxing compartment 5 into the filtration compartment 6. The top of the partition wall 7 does not reach the ceiling surface of the vessel 1, leaving a vacant space therebetween for forming there a communication space 9 linking an upper space above the fluxing compartment 5 and another upper space above the filtration compartment 6. And the height (h) of the partition wall 7 is suitably selected to be slightly higher than the bath surface 10, i.e., surface of the molten metal.

The thus formed fluxing compartment 5 is again divided into two parts as shown in FIG. 2 by a pair of dividers 11, 11 largely projecting from each of opposed inner walls of the vessel 1, to provide a first chamber 13 and a second chamber 14. Between both dividers 11, 11 a communication passage 12 is left. The molten metal 2 treated in the first chamber 13, which is located nearer to the inlet port 3, is led, when the predetermined treatment is finished, into the second chamber 14 for application of another fluxing treatment there. The molten metal 2 is, upon finishing the second treatment, delivered into the filtration compartment 6 through the molten metal passage 8 formed in the lower part of the partition wall 7. In each of the first and second chambers 13, 14 a known stirring mechanism 16 in the form of a rotor is accommodated, being inserted through an insertion hole 15 formed in the ceiling of the vessel 1 as can be seen in FIG. 1, and immersed into the molten metal 2 to a predetermined depth. This stirring mechanism 16 is composed, in this embodiment, of (i) a graphite pipe 18 having an axial hollow passage 17 for a treating gas, (ii) a graphite rotor body 21 threaded around the lower part of the graphite pipe 18, consisting of a horizontal disc portion 19 and four vertical stirring vanes 20, and (iii) a porous plug 22 threaded on the lower end of the graphite pipe 18. The stirring mechanism 16 is connected at the top of the graphite pipe 18 to a predetermined gas supplying mechanism and a driving mechanism, both being not illustrated.

In each of the first and second chambers 13, 14 where the stirring mechanism 16 is accommodated a pair of flow baffling plates 23, 23 are opposedly protruded from the inner wall of the vessel 1. The flow baffling plate 23 having a lower height as shown in FIG. 1 than the bath surface 10 is vertically erected on the bottom of the vessel 1, extending with a predetermined length toward the rotational center of the stirring mechanism 16.

Besides, numeral 24 designates a cover, being two in number, for the insertion hole 15 of the stirring mechanism 16 formed in the ceiling of the vessel 1, and numeral 25 denotes a kind of reinforcement or supporting member. The vessel 1 is further provided with a chimney 26 in the ceiling thereof at a position above the fluxing compartment 5 for discharging exhaust gas. Atmosphere in the vessel 1, particularly in the fluxing compartment 5 can be discharged outwards through the chimney 26.

In the filtration compartment 6 separated by the partition wall 7 on the side of outlet port 4, on the other hand, a plurality of tube filters 30 are horizontally disposed. The molten metal 2 introduced into the filtration compartment 6, through the molten metal passage 8 in the lower portion of the partition wall 7, is permeated or rather passed from outside into the inside of the tube filters 30 through their pipe walls while being filtered there. The molten metal 2 passed through into the interior of the tube filters 30 is further led flowing through a molten metal exit path 31 to the pair of outlet ports 4, 4. The plural tube filters 30, known porous pipe bodies in a predetermined number, made of an aggregate material such as corundum by means of combining it with a glass material or sintering the same, are retained by a pair of side plates 32, 33. And a wedge 34 functions to urge the tube filters 30 towards the side plate 33, in which direction the tube filters 30 are open, so that they may be pressed to the mouth of the molten metal exit path 31. It signifies that the connecting portion between the tube filters 30 and the molten metal exit path 31 is well sealed so as to allow only the filtered molten metal to be introduced from the molten metal exit path 31 to the outlet ports 4, 4. In the ceiling of the vessel 1, above the filtration compartment 6, a known variable flame gas burner 35 capable of burning either with a long flame or a flat flame is provided, so that high temperature combustion flame or combustion gas produced by burning of the gas burner 35 can impart heating to the molten metal 2. In a part of the bottom of the vessel 1 where the filtration compartment 6 is located, a blowing nozzle 36 made of a porous refractory material is provided, through which a predetermined gas coming from a supply pipe 37 is blown into the molten metal 2 in a state of fine discrete bubbles. The blown gas gushed from the blowing nozzle 36 functions to flow and float the molten metal 2 in the filtration compartment 6, and the gas in the bubbled state is effective in restraining the inclusions in the molten metal 2 to be deposited on the surface of the tube filters 30.

The molten metal 2 introduced into the vessel 1 through the inlet port 3 is subjected to the predetermined fluxing treatment in both the first and second chambers 13, 14 in that order with the aid of the stirring mechanisms 16, 16 which are rotated in each chamber. In the meantime a known treating gas, such as nitrogen, argon, other inert gases, or chlorine containing inert gases, introduced from a not-shown gas supplying mechanism by way of the hollow passage 17 of the graphite pipe 18 in the stirring mechanism 16 is blown into the molten metal 2, after having passed the porous plug 22 attached to the lower end of the graphite pipe 18, in a state of fine discrete bubbles; and on the other hand, the graphite rotor body 21 is simultaneously rotated due to the rotation of the graphite pipe 18 connected to the driving mechanism to expedite stirring and flowing of the molten metal 2 together with the circulating action of the treating gas blown into in the discrete bubble status. Sufficient contact thus caused between the molten metal 2 and the treating gas will promote further effective degasification, such as dehydrogenation, $Al+3/2Cl_2 \rightarrow AlCl_3 \uparrow$, etc., sodium removal, for example, $Na+\frac{1}{2}Cl_2 \rightarrow NaCl$, as well as effective separation of suspended oxides and other non-metallic inclusions in the molten metal 2 by means of their floating up to the bath surface 10 through adsorption by the gas.

The molten metal 2, finished with the fluxing treatment is led into the filtration compartment 6, through the molten metal passage 8 formed in the partition wall 7, for being completely removed of the suspended particles therein. It is therefore purified almost perfectly to be of high quality including little dissolved gas and floating non-metallic inclusions particles before being discharged through the outlet ports 4, 4.

The combustion flame or the combustion gas produced by the gas burner 35 disposed in the ceiling of the vessel 1 works for preventing the temperature lowering of the molten metal 2 while it is in the process of filtration. The molten metal 2 held at a high temperature and consequently in good flowability in this way can be effectively and efficiently filtered. The gas burner 35 is in its heating effect highly economical and energy saving in comparison to an electrical heater commonly employed in this type of apparatus, and is further advantageous in its by-effect of heating the molten metal 2 while it is in the fluxing compartment 5. The combustion flame and the combustion gas produced by the gas burner 35 can be partly led, after having hit the bath surface 10 in the filtration compartment 6, through the communication space 9 above the partition wall 7 into the fluxing compartment 5, by being expanded in a horizontal direction, so as to advantageously heat the molten metal 2 undergoing the fluxing treatment. This heating operation using the combustion gas of high temperature from the filtration compartment 6 is particularly advantageous, considering the unfavorable situation for mounting an electrical heating device in the fluxing compartment 5 because of occupation of the ceiling portion there by the insertion holes 15, 15 for the stirring mechanisms 16, 16. The chimney 26 disposed as an exhaust discharging means in the ceiling of the fluxing compartment 5 expedites the introduction of the combustion flame and gas of high temperature from the filtration compartment 6 to the fluxing compartment 5 through the communication space 9 above the partition wall 7, owing to the discharge of the atmosphere. The chimney 26 simultaneously functions to discharge the gas produced from the molten metal 2 by the process of fluxing treatment out of the vessel 1.

The gas burner 35 having two types of function, i.e., the long flame burning and the flat flame burning, is also highly advantageous in its capability of heating the entire vessel 1 evenly and uniformly, when the vessel 1 does not contain the molten metal 2, by expanding the flame in a flat direction, and heating the molten metal 2 in each of the two compartments effectively, while the molten metal 2 is under treatment in the vessel 1, by generating a long flame.

The earlier mentioned blowing of an inert gas such as nitrogen, argon, etc. in the fine discrete bubbles status through the blowing nozzle 36, disposed in the bottom portion of the vessel 1 where the filtration compartment 6 is located, is highly meritorious in its action of redispersing the suspended particles which have been attached and deposited onto the surface of the tube filters 30 by virtue of the fine discrete gas bubbles. This gas blowing not only contributes to elongating the life of the tube filters 30 due to prevention of the inclusions depositing thereon, and to enabling the molten metal treatment for a longer period or a larger volume, but also contributes to effective filtration of the molten metal 2 through uniformalization of the molten metal temperature and prevention of the mesh clogging of the filters. The gas blowing from the nozzle 36 is executed not only during the progress of the filtration of the molten metal 2 but also during the stationary holding of the molten metal 2 in the vessel 1. In the latter case wherein the gas blowing is utilized only for maintaining the temperature of the stationary molten metal 2, it is similarly effective in uniformalization of the temperature and elongation of the filter life.

Disposition of the flow baffling plates 23 in the first and second chambers (13, 14) of the fluxing compartment 5, protruded from either side wall of the vessel 1, will disturb or baffle the smooth flowing of the molten metal 2 due to the rotation of the graphite rotor body 21, for producing complex turbulence there. Beside effective contact between the molten metal 2 and the fine discrete gas bubbles caused by the turbulence, suspended particles floated and flowed in the molten metal 2 due to the rotation of the graphite rotor body 21 tend to be pushed outside the turbulence and positively accumulated in the neighborhood of the root of the flow baffling plates 23. Supposed effect of floating and removal of those harmful particles in the molten metal 2 evidently proved, in this embodiment, noticeable decreasing of the amount of the harmful particles in the molten metal 2 under the fluxing treatment which is flowed from the second chamber 14 to the filtration compartment 6 through the molten metal passage 8. It largely contributed to the prevention of the clogging of the filtering means, namely the tube filters 30 in the filtration compartment 6 located downstream the second chamber 14 and its life elongation.

According to the study of the inventor of this invention, the following noticeable improvement, in a molten aluminum treatment case employing an apparatus of this invention, was proved in comparison to the undermentioned effects of degasification and particle removal in cases wherein the fluxing treatment and the filtration treatment were carried out independently.

Common Treatment Conditions:

Treating gas; argon gas

Flow amount; 100 l/min.

Treatment rate; 15 ton/hour

This Invention:

Degasification Effect; $\bar{x}=0.11$ (0.08–0.13) ($H_2$ ml/100 g.Al)

Particle Removal Effect; 0–2 remaining particles (per one finished sheet of 0.5 mm thickness and 1000 mm square)

Prior Arts (Fluxing Treatment or Filtration Treatment):

Degasification Effect; $\bar{x}=0.15$ or 0.3

Particle Removal Effect; 0–5 or 2–10.

Regarding the life of the tube filters, this embodiment showed a result of continuous molten metal treatment of 700–1000 tons, while a treatment apparatus provided only with a filtration compartment had to stop the continuous treating operation at the extent of 200–400 tons.

Although the above description is concerned only to a preferable embodiment, this invention is not limited thereto, but it can be variously modified or altered, without departing from the spirit of the invention, by those skilled in the art. As to the burner, for instance, an oil burner is also permissible, not being limited to the earlier mentioned most preferable gas burner. Other kinds of known filters than the tube filters are also allowable. As for the stirring mechanism disposed in the fluxing compartment of the vessel, disposition either of a single mechanism or more than two ones, instead of the pair in the embodiment, is possible. And the structure of the stirring mechanism in the embodiment may be replaced by that disclosed in the U.S. Pat. Nos. 3,743,263 and 3,839,019, and in a laid open publication of patent application: TOKU-KAI-SHO-54(1979)142104 (Japan).

What is claimed is:

1. An apparatus for treating a molten metal comprising:

a treating vessel of sealed structure having inlet means for introducing molten metal to be treated and outlet means for discharging treated molten metal;

a partition member vertically extending in said treating vessel to divide same into a fluxing compartment located on the side of said inlet means and a filtration compartment on the side of said outlet means, and having in a lower portion thereof a molten metal passage for leading the molten metal from said fluxing compartment into said filtration compartment, the top of said partition member being spaced from a ceiling portion of said treating vessel to define therebetween a communication space communicating an upper space in said fluxing compartment with an another upper space in said filtration compartment;

molten metal treating means disposed in said fluxing compartment for treating the molten metal introduced through said inlet means, said treating means including a vaned rotor and having treating gas blowing means for blowing a treating gas into said molten metal in the form of fine discrete bubbles while said vaned rotor is rotated to stir and circulate said molten metal;

filtering means for removing suspended particles from said molten metal and delivering the filtered molten metal out of said treating vessel through said outlet means, said filtering means being disposed in said filtration compartment for filtering said molten metal introduced from said fluxing compartment into said filtration compartment through said molten metal passage;

burner means, disposed in said ceiling portion of said treating vessel and located over said filtration compartment, for producing combustion flame and/or combustion gas and high temperature and heating said molten metal in said fluxing compartment as well as the molten metal in said filtration compartment before it is filtered by said filtering means; and exhaust gas discharging means, supported in said ceiling portion and located over said fluxing compartment, for discharging out of said treating vessel exhaust gas produced in said fluxing compartment, said exhaust gas discharging means introducing combustion gas produced by said burner means into said fluxing compartment through said communication space and discharging said combustion gas out of said vessel, whereby the molten metal in said fluxing compartment is heated by said combustion gas introduced into the fluxing compartment by said exhaust gas discharging means.

2. An apparatus according to claim 1, further comprising at least one flow baffling plate disposed in said fluxing compartment so as to extend from inner wall of said treating vessel, said baffling plate(s) baffling a smooth flow of the molten metal generated by rotation of the rotor of said molten metal treating means.

3. An apparatus according to claim 1, further comprising gas blowing means disposed in a bottom portion of said vessel and constituting a part of said filtration compartment, said blowing means blowing gas therefrom in the form of fine discrete bubbles which cause the molten metal to flow in said filtration compartment and which contact with the surfaces of said filtering means.

4. An apparatus according to claim 1, wherein said burner means comprises a variable flame gas burner capable of burning with selectively producing a long flame and a flat flame.

5. An apparatus according to claim 1, wherein said filtering means comprises a plurality of tube filters each having an end open to said outlet means.

6. An apparatus according to any one of claims 1, 2, 3, 4 or 5, wherein said molten metal is aluminum or its alloy.

7. An apparatus for treating a molten metal comprising:

a treating vessel sealed structure having inlet means for introducing molten metal to be treated and outlet means for discharging treated molten metal;

a partition member vertically extending in said treating vessel to divide same into a fluxing compartment located on the side of said inlet means and a filtration compartment on the side of said outlet means, and having in a lower portion thereof a molten metal passage for leading the molten metal from said fluxing compartment into said filtration compartment, the top of said partition member being spaced from a ceiling portion of said treating vessel to define therebetween a communication space communicating an upper space in said fluxing compartment with an another upper space in said filtration compartment;

molten metal treating means disposed in said fluxing compartment for treating the molten metal introduced through said inlet means, said treating means including a vaned rotor and having a passage blowing treating gas into said molten metal in the form of fine discrete bubbles while said vaned rotor is rotated to stir and circulate said molten metal;

a plurality of tube filters of porous structure disposed in said filtration compartment and each having a closed end leading to said outlet means, said tube filters removing suspended particles from the molten metal introduced from said fluxing compartment into said filtration compartment through said molten metal passage and delivering the filtered molten metal out of said treating vessel through said open end and said outlet means;

burner means, disposed in said ceiling portion of said treating vessel and located over said filtration compartment, for producing combustion flame and/or combustion gas of high temperature and heating said molten metal in said fluxing compartment by said combustion gas initroduced to the fluxing compartment through said communication space, as well as heating the molten metal in said filtration compartment before it is filtered by said tube filters; and gas blowing means disposed in a bottom portion of said vessel and constituting a part of said filtration compartment, said blowing means blowing gas therefrom in the form of fine discrete bubbles which contact with the surfaces of said tube filters and which cause the molten metal to flow in said filtration compartment thereby cooperating with said burner means to maintain uniform temperature of the molten metal in the filtration compartment.

8. An apparatus according to claim 7, further comprising at least one flow baffling plate disposed in said fluxing compartment so as to extend from inner wall of said treating vessel, said baffling plate(s) baffling a smooth flow of the molten metal generated by rotation of said vaned rotor of said molten metal treating means.

* * * * *